US005373796A

United States Patent [19]

Besemann

[11] Patent Number: 5,373,796

[45] Date of Patent: Dec. 20, 1994

[54] METHOD OF AND APPARATUS FOR SEWING TOGETHER LAYERS OF OVERLAPPING SHEETS

[75] Inventor: Alfred Besemann, Halstenbek, Germany

[73] Assignee: E. C. H. Will GmbH, Hamburg, Germany

[21] Appl. No.: 12,263

[22] Filed: Feb. 1, 1993

[30] Foreign Application Priority Data

Feb. 12, 1992 [DE] Germany ..... 4203988

[51] Int. Cl.[5] ..... D05B 23/00

[52] U.S. Cl. ..... 112/262.1; 112/48; 112/89

[58] Field of Search ..... 112/262.1, 262.3, 48, 112/89, 303, 310, 285, 288

[56] References Cited

U.S. PATENT DOCUMENTS 3,779,184 12/1973 Jean Blanc ..... 112/48 X
4,077,340 3/1978 Braun et al. ..... 112/89 X
4,506,611 3/1985 Parker ..... 112/262.2 X

*Primary Examiner*—Peter Nerbun
*Attorney, Agent, or Firm*—Darby & Darby

[57] ABSTRACT

Successive stacks of overlapping paper sheets are transported toward a sewing station where the sheets of successive stacks are sewn together by a sewing machine. In order to reduce the generation of heat at the sewing station and the resulting breakage of thread and damage to the needle or needles, successive stacks are provided with rows of holes ahead of the sewing station. The distribution of holes in the stacks and the mode of transporting stacks toward and through the sewing station are selected with a view to ensure that the needle or needles penetrate into the prefabricated holes with a minimum of friction. The surplus of thread is trimmed off the products downstream of the sewing station. Such products can constitute books, brochures, pads or other commodities containing stacks of sewn together sheets of paper or other sheet material.

21 Claims, 2 Drawing Sheets

Fig.2a
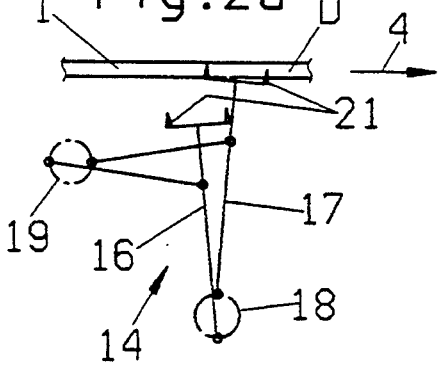
Fig.2b
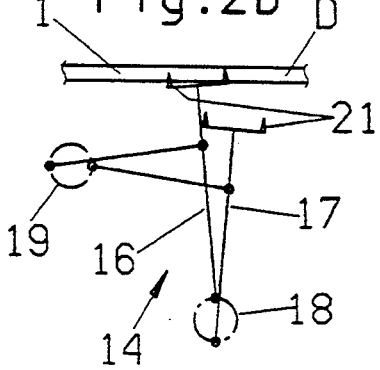
Fig.2c
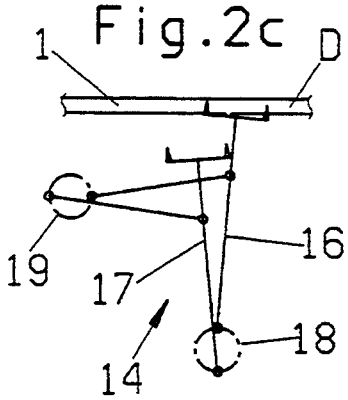
Fig.2d
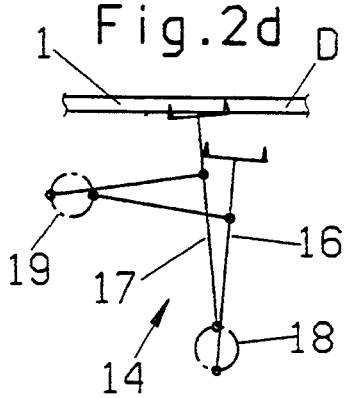
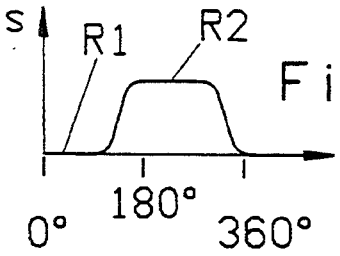
Fig.3a
Fig.3b
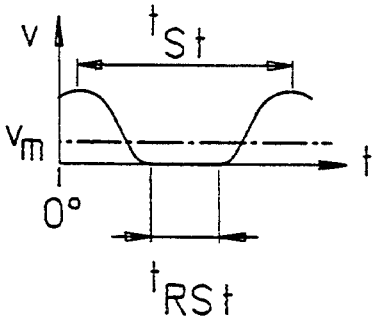
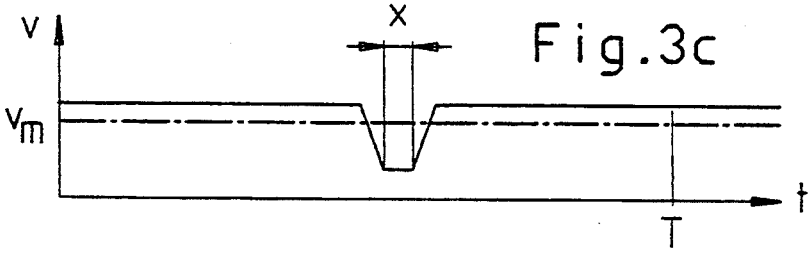
Fig.3c

METHOD OF AND APPARATUS FOR SEWING TOGETHER LAYERS OF OVERLAPPING SHEETS

BACKGROUND OF THE INVENTION

The invention relates to a method of and to an apparatus for sewing together overlapping sheets of paper or the like. More particularly, the invention relates to improvements in methods of and in apparatus for sewing together stacks, layers or similar accumulations (hereinafter called layers) of at least partially overlapping sheets by resorting to filaments, threads or other flexible connectors (hereinafter called threads). Still more particularly, the invention relates to improvements in methods of and in apparatus for connecting sheets which together form layers of sheets by resorting to one or more threads which are applied by one or more sewing machines. For example, the thus obtained sewn together layers of sheets can constitute or form part of books, brochures, memo pads, steno pads or analogous commodities.

A drawback of presently known methods and apparatus for making books, brochures, pads and like products by sewing together layers of superimposed or overlapping sheets is that the generation of heat, attributable primarily to ever increasing thickness of the layers and to ever increasing output of the apparatus, is sufficiently high to cause frequent breakage of threads and damage to the needle or needles of the sewing machine or machines.

OBJECTS OF THE INVENTION

An object of the invention is to provide a method which renders it possible to sew together thicker or thinner layers of overlapping sheets without the generation of excessive heat.

Another object of the invention is to provide a method which can be practiced to sew together thick or thin layers of overlapping sheets of paper or the like in such a way that the thread or threads which are used for sewing are not unduly affected by heat.

A further object of the invention is to provide a method which renders it possible to sew together layers of overlapping sheets at a high frequency and with a high degree of accuracy.

An additional object of the invention is to provide a method which can be resorted to for the practically uninterrupted making of short or long series of books, brochures, pads or like accumulations of sewn together overlapping sheets.

Still another object of the invention is to provide a method which renders it possible to prolong the useful life of needles in the machine or machines serving to sew together layers of overlapping sheets of paper or other sheet material.

A further object of the invention is to provide a novel and improved method of transporting successive layers of overlapping sheets toward, through and beyond the range of one or more sewing machines.

Another object of the invention is to provide a novel and improved apparatus for the practice of the above outlined method.

An additional object of the invention is to provide the apparatus with novel and improved means for preparing layers of overlapping sheets for treatment at a sewing station.

Still another object of the invention is to provide the apparatus with novel and improved means for transporting layers of overlapping sheets toward, past and beyond one or more sewing machines.

A further object of the invention is to provide the apparatus with novel and improved means for synchronizing the movements of various sheet engaging and entraining means with the movements of the needle or needles at the sewing station.

Another object of the invention is to provide the apparatus with novel and improved means for prolonging the useful life of the needle or needles in the sewing machine or machines serving to sew together the sheets in successive layers of overlapping sheets which are to be converted into books, stationery products or other commodities containing stacks of connected sheets.

An additional object of the invention is to provide the apparatus with a novel and improved combination of sheet sewing and layer transporting means.

SUMMARY OF THE INVENTION

One feature of the present invention resides in the provision of a method of sewing together layers of overlapping sheets (such as paper sheets) with threads along lines of stitches. The method comprises the steps of providing a layer with a series of holes along a contemplated line of stitches, and thereafter introducing thread through such series of holes to sew the sheets of the layer to each other.

The step of providing holes can include removing material from the sheets of the layer (e.g., by resorting to one or more hollow punches) or puncturing the layer (e.g., with an array of needles).

The step of providing holes in a layer can be carried out in a plurality of stages, and each such stage can include the making of a plurality of holes.

The method is preferably carried out in such a way that it involves the sewing together of overlapping sheets in each of a series of layers at a sewing station. Such method further comprises the step of transporting the layers of the series in a predetermined direction along a predetermined path extending through the sewing station. The transporting step can include advancing each layer in the predetermined direction in a plurality of successive first stages or steps, and the step of providing holes can include moving at least one hole making tool across the path upstream of the sewing station in a plurality of second stages or steps each of which can at least partially coincide with one of the first stages. If the path is at least substantially horizontal, the advancing step preferably includes advancing each layer substantially horizontally at timely spaced intervals. The step of moving the tool can include moving the tool up ant down at timely spaced intervals. Each of the aforementioned plurality of first stages includes a last stage which results in advancement of the respective layer to a predetermined position in the predetermined path, and the transporting step of such method can further comprise stepwise conveying successive layers from the predetermined position through the sewing station at a predetermined frequency. The thread introducing step of such method preferably comprises introducing thread through successive holes of a layer at the sewing station at such predetermined frequency. The aforementioned conveying step can include causing a conveying tool to penetrate a hole of the layer which reaches the predetermined position and moving the tool toward the sewing station.

The method preferably further comprises the step of trimming thread which holds the sheets of successive layers together downstream of the sewing station. The introducing step can result in the entrainment of surplus thread at opposite sides of each layer which advances beyond the sewing station, and the trimming step then preferably includes severing surplus thread at both sides of each layer.

Another feature of the present invention resides in the provision of an apparatus for the practice of the above outlined method, namely an apparatus for sewing together layers of overlapping sheets of paper or the like with thread along lines of stitches. The improved apparatus comprises means for transporting a series of layers in a predetermined direction along a predetermined path, means for making pluralities of holes in successive layers of the series along the contemplated lines of stitches in a first portion of the path, and at least one sewing machine having means for introducing thread through the holes of successive layers in a second portion of the path downstream of the first portion.

The means for introducing thread normally includes means for forming a predetermined pattern of stitches, and the means for making holes preferably includes means for making a pattern of holes conforming to the pattern of stitches.

The means for making holes can include an array of tools which are set up to simultaneously form a plurality of holes forming a pattern of holes in a layer in the first portion of the path. The arrangement may be such that the number of tools in the array of tools at most equals one-half the number of holes in each plurality of holes, i.e., in each layer.

The means for making holes can further comprise first drive means for moving the aforementioned array of tools or an otherwise distributed plurality of tools transversely of the predetermined path at first intervals, and second drive means for moving such plurality of tools in the predetermined direction at second intervals each of which can at least partially coincide with one of the first intervals. The just discussed tools and the second drive means can be said to form part of the transporting means.

The transporting means can comprise means for positively conveying layers in the predetermined direction in a third portion of the predetermined path between the first and second portions of such path. The conveying means can comprise at least one tool having means (e.g., two needles) for entering the holes of layers arriving from the first portion of the path. It is presently preferred to install at the third portion of the path a conveying means which comprises first and second tools each having means for entering the holes of layers arriving from the first portion of the path and means for alternatingly engaging the first and second tools with a layer in the third portion of the path in order to advance such layer toward the at least one sewing machine.

The apparatus preferably further comprises means for trimming thread which is introduced into the holes of layers in the second portion of the path. The sewing together of sheets constituting successive layers of the series can involve the application of thread which extends beyond opposite sides of a layer downstream of the second portion of the path, and the trimming means then preferably comprises means for trimming thread at both sides of successive layers which have advanced beyond the sewing machine.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 2*a* is an enlarged schematic side elevational view of an advancing device which is utilized in the apparatus of FIG. 1*d;*

FIG. 2*b* illustrates the advancing device of FIG. 2*a* during a different stage of advancement of a layer of sheets toward the sewing station;

FIG. 2*c* illustrates the advancing device of FIG. 2*b* during a third stage of advancement of a layer toward the sewing station;

FIG. 2*d* illustrates the advancing device of FIG. 2*d* during a fourth stage of advancement of a layer toward the sewing station;

FIG. 3*a* is a diagram showing various positions of hole making tools during different stages of the making of holes in a layer of overlapping sheets advancing through the respective portion of the path of such sheets in the improved apparatus;

FIG. 3*b* is another diagram showing various stages of stitch making in a layer at the sewing station; and FIG. 3*c* is a further diagram showing variations of the speed of main driving unit in the apparatus which is shown in FIGS. 1*a* to 2*d*.

DESCRIPTION OF PREFERRED EMBODIMENTS

Figures 1A, 1B, 1C, 1D:
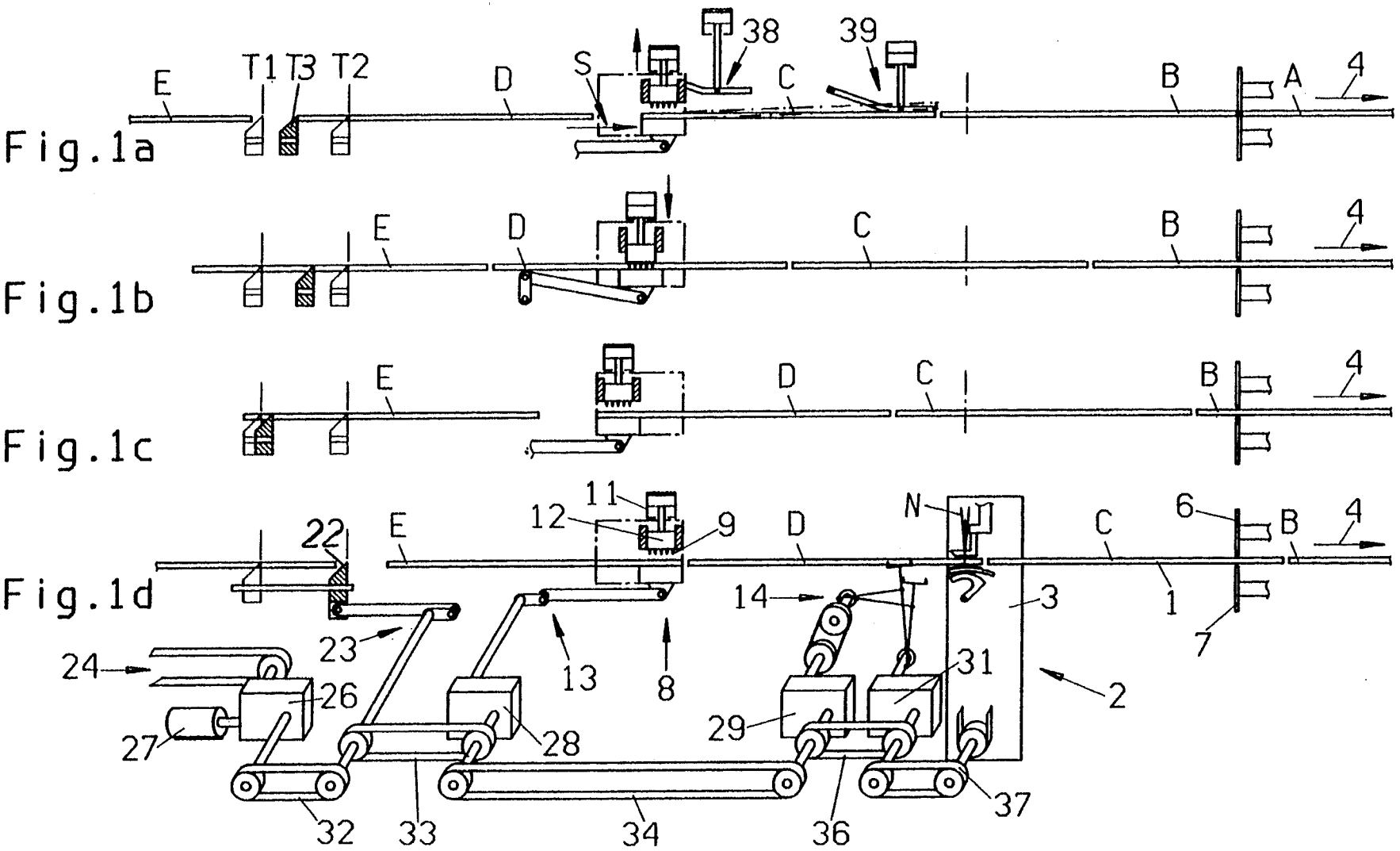
FIG. 1*a* is a schematic elevational view of a portion of an apparatus which embodies one form of the invention, with the advancing means and the sewing machine omitted.
FIG. 1*b* illustrates the structure of FIG. 1*a* but with a series of layers of overlapping sheets in different positions and the means for making holes in the process of providing a portion of one of the layers with an array of holes.
FIG. 1*c* shows the structure of FIG. 1*b* but with the layers in further positions and the tools of the hole making means in the process of advancing the adjacent layer of sheets toward the sewing station.
FIG. 1*d* shows the structure of FIGS. 1*a* to 1*c* as well as several additional constituents of the apparatus, with the sewing machine in the process of making stitches in the adjacent layer of sheets by causing thread to pass through holes made in the layer upstream of the sewing station.

The apparatus which is shown in FIGS. 1*a* to 1*d* and 2*a* to 2*d* comprises a sewing machine 3 which is installed at a sewing station 2 and includes one or more needles N serving to introduce thread through prefabricated holes extending along predetermined lines of stitches to be made by the machine 3 in successive layers 1 of at least partially overlapping sheets of paper or other sheet material. For example, the sewing machine 3 can be of the type known as Series 477 in line twin chain stitch machine produced and distributed by the firm Dürkopp & Adler, Bielefeld, Federal Republic Germany. FIGS. 1*a* to 1*d* illustrate a series (A to E) of successive layers 1 each of which includes or constitutes a stack of partially or fully overlapping sheets of paper or the like. The illustrated apparatus can constitute one of a set of two or more apparatus which simultaneously process discrete series of layers 1 obtained as a result of subdivision of larger panels or sheets of paper as is customary in plants for the binding of books, pamphlets and/or brochures as well as in plants for the making of pads and similar stationery products. The illustrated apparatus can be set up in such a way that successive layers 1 are transported along a substantially horizontal path and that each layer of the series A to E is provided with a line of stitches across its central portion. If the products which advance beyond the sewing station 2 are to constitute pamphlets or brochures, each such product is simply folded along the centrally located line of stitches so that the stitches are disposed in the back or spine of the thus obtained product.

In addition to the sewing machine 3 at the station 2, the improved apparatus further comprises means for transporting successive layers along the substantially horizontal path in the direction of arrow 4. Surplus thread which extends from the upper side and from the underside of a layer 1 advancing beyond the sewing station 2 is trimmed off by two rotary cutters 6 and 7. The exact manner of trimming off surplus thread at opposite sides of the products downstream of the sewing station 2 forms no part of the present invention.

In accordance with a feature of the invention, the improved apparatus further comprises means (denoted in FIG. 1*d* by the character 8) for providing each of the illustrated series A to E of successive layers 1 with a series of holes along a contemplated line of stitches, namely along the line of stitches which are thereupon made by the needle or needles N of the sewing machine 3 at the station 2. The illustrated means 8 for providing holes (hereinafter called unit or perforating unit) includes an array of tools 9 which can constitute hollow punches capable of actually removing some material at the locus of penetration through the overlapping sheets of a layer at the station accommodating the unit 8, or an array of tools acting not unlike needles capable of piercing the sheets of a layer 1 but without effecting the removal of any material from the pierced sheets. The distribution of tools 9 in the array which is shown in FIGS. 1*a* to 1*d* is such that the spacing of holes made along the contemplated line of stitches in a layer 1 which has been transported beyond the path portion for the unit 8 is the same as the spacing of those portions of thread which are introduced by the needle N at the sewing station 2 and pass through the sheets of the layer 1 at the station 2. In other words, the needle N will penetrate into holes which were made by the tools 9 of the unit 8.

It is clear that the tools 9 of the array forming part of the unit 8 need not form a single row of holes; this depends on the nature of stitches to be made by the needle N of the sewing machine 3 at the station 2. It is assumed, for the sake of simplicity, that the tools 9 provide each layer 1 with a single row of holes and, accordingly, that the needle N causes one or more threads to form a single row of stitches across the middle of each layer 1 which is being transported through the sewing station 2.

The unit 8 further comprises a first drive means here shown as a cylinder and piston assembly 11 disposed at the upper side of the respective portion of the path for the layers 1 and serving to intermittently move the array of tools 9 up and down (i.e., transversely of the path for the layers 1) at a selected frequency whereby the tools 9 make a series of holes during each downward stroke of the preferably membrane-like piston in the cylinder of the assembly 11. The piston rod of the assembly 11 carries a ram 12 which, in turn, carries the tools 9 of the unit 8. The entire assembly 11 is movable forwardly and backwards (in and counter to the direction indicated by the arrow 4) by a crank drive 13 forming part of the unit S and including an anvil 10 for the ram 12 which carries the array of tools 9. The anvil 10 is reciprocable forwardly and backwards (i.e., toward and away from the sewing station 2) along a substantially horizontal path to cooperate with the tools 9 in advancing the adjacent layer 1 by a step toward the station 2 when the ram 12 assumes its lower end position (the tools 9 then extend into the holes in the adjacent layer 1) and the crank drive 13 causes its anvil 10 to perform a forward stroke in the direction of arrow 4.

The length of the array or row of tools on the ram 12 of the assembly 11 is a fraction (normally not more than one-half) of the overall length of a full line or row of holes made in a layer 11 whose leader arrives at the sewing station 2. In other words, the making of a full line of holes in a layer 1 involves the carrying out of a number of vertical downward strokes by the ram 12 and a number of horizontal forward strokes by the anvil 10. For example, the arrangement may be such that a layer 1 will perform a total of eight successive stepwise advances toward the sewing station 2 in order to be provided with a full line of holes for reception of thread at the sewing station 2. However, the apparatus can employ a unit 8 which carries a larger array of tools 9, e.g., an array which suffices to complete the making of approximately 50 percent of the total number of holes in a layer 1 in response to a single downward stroke of the ram 12.

It is within the purview of the invention to provide the unit 8 with discrete drives for individual tools 9 or for smaller groups of tools 9. This would enable the operators to select the format of stitches by selecting the number of tools which descend into engagement with and penetrate through the sheets of the adjacent layer 1. In the relatively simple perforating unit 8 which is shown in FIGS. 1*a* to 1*d*, all of the tools 9 are assumed to simultaneously move up or down (under the influence of the assembly or drive 11) as well as forwardly and backward (under the influence of the crank drive 13).

In accordance with another feature of the invention, the means for transporting successive layers 1 of the series (such as A to E) of such layers toward, through and beyond the sewing station 2 comprises the aforementioned tools 9 and the crank drive 13 as well as a conveying or advancing device 14 which is adjacent a portion of the path for the layers 1 between the sewing station 2 and the unit 8. The operation of the conveying device 14 is synchronized with that of the sewing machine 3 so that a layer 1 which has been provided with a row of holes is intermittently fed into the sewing station 2 at the same rate at which the needle N of the machine 3 makes stitches by causing thread to pass through the prefabricated holes of the adjacent layer. As can be seen in FIGS. 2*a* to 2*d*, the conveying device 14 comprises two tools 16, 17 each of which carries means 21 (here shown as a pair of spaced-apart needles 21) for entering the holes of the adjacent layer 1 and for intermittently conveying or advancing the layer toward the sewing machine 3 at the station 2. Each of the two tools 16, 17 receives motion from a first eccentric or crank drive 18 which can move the tools 16 and 17 up and down (i.e., substantially transversely of the adjacent portion of the path for the layers 1), and also from a second eccentric or crank drive 19 which causes the needles 21 of the two tools to perform alternating forward and return strokes, for example, in such a way that each stroke under the action of the drive 18 partially coincides with a stroke initiated by the drive 19. The distance between the needles 21 on the tool 16 or 17 preferably matches twice the distance between a pair of neighboring prefabricated holes.

The means for feeding successive layers 1 of the series A to E into the range of the unit 8 includes a pusher 22 which can engage the trailing ends of successive layers and receives motion from a crank drive 23 (FIG. 1*d*).

The crank drive 23 receives motion from a main driving unit 24 which further transmits motion to the mobile parts of the unit 8, conveying device 14 and sewing machine 3. The unit 24 transmits motion to the unit 8, device 14 and machine 3 through an adjustable (variable-speed) transmission 26 whose ratio can be selected by a motor 27. The output element of the transmission 26 transmits motion to the unit 8, device 14 and machine 3 through stepping motors 28, 29, 31 and belt transmissions 32, 33, 34, 36 and 37 (all shown in FIG. 1*d*). Other types of drive means can be used with equal or similar advantage; for example, each of the components 8, 14 and 3 can receive motion from a discrete prime mover and the discrete prime movers are then properly controlled to ensure accurate synchronization of movements of mobile parts of the unit 8, conveying device 14 and sewing machine 3.

FIG. 1*a* shows a clamping device 38 which cooperates with the unit 8, and a biasing device 39 which acts not unlike an anvil and cooperates with the conveying device 14 to ensure predictable advancement of freshly perforated layers 1 from the unit 8 toward and through the sewing station 2.

FIG. 1*a* illustrates the array of tools 9 forming part of the unit 8 immediately after completion of the last stage of making a complete row of holes along the contemplated line of stitches in the layer C, i.e., in the trailing portion of the layer C. The trailing end of the layer C is already provided with holes and the tools 9 have cooperated with the crank drive 13 and anvil 10 to advance the layer C by a step (shown at S) in the direction of arrow 4. This has caused the layer C to assume a predetermined position in which its leader is located beneath the biasing device 39 serving to lower the adjacent portion of the layer C into the range of needles 21 on the tools 16, 17 of the conveying or advancing device 14.

FIG. 3'a is a diagram showing the movements of tools 9 forming part of the unit 8. The character R1 denotes an interval of rest during which the tools 9 extend into and through the sheets of the adjacent layer of overlapping sheets, and the character R2 denotes the interval of withdrawal of tools 9 from the adjacent sheets. The two intervals partially overlap at the end of the interval R1 as well as at the end of the interval R2. The angular movements of the crank drive 13 are measured along the abscissa and the movement of the layer 1 at the station for the unit 8 is measured along the ordinate of the coordinate system which is shown in FIG. 3*a*.

When the crank drive 13 causes the unit 8 to perform a return stroke counter to the direction of arrow 4, the clamping device 38 is lowered toward engagement with the layer 1 to hold the latter against movement with the (disengaged) tools 9 and anvil 10 in a direction away from the sewing station 2. The clamping device 38 engages and holds the adjacent layer against movement counter to the direction which is indicated by arrow 4 until the crank drive 13 completes a full revolution. At the same time, the pusher 22 is in the process of bearing against the trailing end of the layer D (FIG. 1*a*) and of advancing this layer in the direction of arrow 4, i.e., into the range of the unit 8. The crank drive 23 causes the pusher 22 to advance from a first or rear dead center position T1 to a second or front dead center position T2 which suffices to advance the leader of the layer D into the range of that portion (9, 13) of the transporting means of the improved apparatus which forms part of the unit 8. From there on, the tools 9 and the anvil 10 take over to advance the layer D stepwise through the station for the unit 8 and to the predetermined position (corresponding to that of the layer C in FIG. 1*a*) in which the transport of the layer D is taken over by the conveying or advancing device 14. The reference character T3 denotes in FIG. 1*a* an intermediate position of the pusher 22.

FIG. 1*b* illustrates the layer D in a position not immediately following the position of FIG. 1*a*. Thus, the tools 9 are in the process of making a series of holes in an intermediate portion (rather than in the leader) of the layer D. The crank drive 13 cooperates with the assembly 11 (i.e., with the tools 9 which have penetrated into and through the sheets of the layer D shown in FIG. 1*b*) to advance the layer D by a step toward the sewing station 2, i.e., in the direction of arrow 4.

FIG. 1*c* shows the assembly 11 in a position in which the tools 9 are lifted above and away from contact with the adjacent portion of the layer D, namely with the trailing end of this layer. The next step involves lowering the ram 12 with the tools 9 and advancing the tools 9 by the drive 13 so that the layer D reaches the predetermined position (in which its leader is in the range of needles 21 on the tools 16, 17 of the conveying device 14). FIG. 1*d* shows the layer D in such predetermined position; the leader of the next-following layer E is in the range of tools 9 forming part of the unit 8. The biasing device 39 then presses the layer D against the needles 21 of the tools 16, 17 during a relatively long interval preceding first penetration of needle N into the adjacent prefabricated hole in the leader of the layer D. This is achieved in a manner as best shown in the diagram of FIG. 3*c*, namely by reducing the RPM of the entire drive in order to lengthen the interval $t_{RSt}$ shown in the diagram of FIG. 3*b*. The character $t_{St}$ denotes in FIG. 3*b* the interval of time elapsing during the making of a stitch by the needle N, and the character $v_m$ denotes in each of FIGS. 3*b* and 3*c* the average speed of forward movement of a layer. The reduction of RPM (as indicated at x in FIG. 3*c*) is achieved by appropriate adjustment of the transmission 26 via motor 27.

The layer D is advanced stepwise through the sewing station 2 at a rate corresponding to the rate of making stitches by the needle N of the machine 3. Such advancement is effected by the tools 16, 17 of the conveying device 14. The needles 21 of these tools penetrate into the prefabricated holes of the layer D. Thus, when the stepwise forward transport of the layer D by the needles 21 of the tool 17 in the direction of arrow 4 is completed (see FIG. 2*a*), the needles 21 of the tool 17 are extracted from the adjacent holes of the layer D and the tool 16 is caused to lift its needles 21 into the adjacent holes of the same layer D (FIG. 2*b*). FIG. 2*c* shows the drive 18 in a state of idleness but the drive 19 is operative to advance the tool 16 (and hence the layer D) in the direction of arrow 4. At such time, the needles 21 of the drive 17 are disengaged from the layer D. FIG. 2*d* shows that the needles 21 of the tool 16 are extracted from the holes of the layer D but the drive 19 is operative to advance the needles 21 of the tool 17 (and hence the layer D) toward the sewing station 2. The same sequence of operations is repeated again and again until the sewing of stitches in the layer D is completed. The tools 16 and 17 cooperate with their drives 18 and 19 to ensure that the needle N invariably enters a hole of the adjacent layer 1 with a minimum of friction so that the development of heat is not sufficient to affect the stability of thread which is being manipulated by the needle N. This reduces the number of breaks of thread and prolongs the useful life of the needle N and of the entire sewing machine 3. All this is accomplished with the novel expedient of causing the needle N to enter holes which are made in an upstream portion of the path for the layers 1. Furthermore, the apparatus can turn out large numbers of books, brochures, pamphlets, pads or other multiple-sheet commodities per unit of time because the needle N is not required to make holes but merely introduces thread into prefabricated holes of the adjacent layers 1.

The improved apparatus is susceptible of numerous additional modifications without departing from the spirit of the invention. For example, the perforating unit 8 can be replaced by a system utilizing one or more lasers to burn holes into the sheets of successive layers in the path extending through the perforating, advancing and sewing stations. The illustrated mechanically operated unit 8 is preferred at this time because it is capable of performing a number of functions including making holes in the overlapping sheets of successive layers 1 as well as for example, advancing the layers at a selected frequency and by steps of selected length in a direction toward and directly into the sewing station 2 or into the range of the conveying device 14.

It is also possible to perforate the layers while the layers are in continuous motion. However, it is presently preferred to perforate in a number of successive stages so that the movements of layers at the hole making station can be properly related to stepwise movements of layers through the sewing station 2.

The illustrated unit 8 exhibits the additional advantage that it does not deform the layers in the regions where its tools 9 are operative to make holes in the overlapping sheets of such layers. At the same time, the unit 8 ensures rapid and predictable advancement of layers 1 toward the sewing station 2, i.e., into the range of needles 21 on the tools 16, 17 of the conveying device 14. This is achieved by the expedient of ensuring that the up and down movements of the tools 9 under the action of the assembly 11 at least partially coincide with forward and rearward movements of the anvil 10 under the action of the crank drive 13 which also moves the assembly 11 in and counter to the direction of arrow 4. The steps which are carried out by the anvil 10 in and counter to the direction of arrow 4 are or can be much longer than the steps which must be performed by a layer 1 at the station 2 in order to move successive holes into register with the needle N. The difference between the advances of a layer 1 at the station for the unit 8 and at the sewing station 2 is accounted for by the conveying device 14 which takes over when the hole making step is completed and thereupon advances a layer by steps of optimum length and at an optimum frequency in order to reduce friction between the needle N and the holes in the layer which happens to be located at the sewing station 2. All that is necessary is to ensure that the last hole making stage of the step carried out at the station for the unit 8 results in advancement of the leader of a freshly perforated layer (such as the layer C in FIG. 1*a*) to a predetermined position, namely into the range of needles 21 on the tool 16 or 17 at the station for the conveying device 14.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of sewing together overlapping sheets of each of a series of layers at a sewing station with thread along lines of stitches, comprising the steps of forming a series of holes in successive layers along a contemplated line of stitches; thereafter introducing thread through said series of holes to sew the sheets to each other; and transporting the layers of the series in a predetermined direction along a predetermined path extending through the sewing station, said transporting step including advancing each layer in said direction in a plurality of successive first stages, said step of providing holes including moving a hole making tool across said path upstream of said station in a plurality of second stages each of which at least partly coincides with one of said first stages.

2. The method of claim 1, wherein said step of forming holes includes removing material from the sheets of each respective layer.

3. The method of claim 1, wherein said step of forming holes includes puncturing each respective layer.

4. The method of claim 1, wherein said step of forming holes is carried out in a plurality of stages.

5. The method of claim 4, wherein each of said stages includes the making of a plurality of holes.

6. The method of claim 1, wherein said path is at least substantially horizontal and said advancing step includes advancing each layer substantially horizontally at timely spaced intervals, said step of moving the tool including moving the tool up and down at timely spaced intervals.

7. The method of claim 1, wherein each of said plurality of successive first stages includes a last first stage which results in advancement of the respective layer to a predetermined position in said path, said transporting step further comprising stepwise conveying successive layers from said predetermined position through the sewing station at a predetermined frequency.

8. The method of claim 7, wherein said thread introducing step includes introducing thread through successive holes of a layer at said station at said frequency.

9. The method of claim 7, wherein said conveying step includes causing a conveying tool to penetrate a hole of the layer reaching said predetermined position and moving the tool toward said station.

10. The method of claim 1 of sewing together overlapping sheets of each of a series of layers at a sewing station, further comprising the steps of transporting the layers of the series along a predetermined path toward, through and beyond said station and trimming the thread passing through the holes of successive layers downstream of said station.

11. The method of claim 10, wherein the introducing step results in the entrainment of surplus thread at opposite sides of a layer which has been transported beyond said stations and said trimming step includes severing surplus thread at both sides of each layer.

12. Apparatus for sewing together layers of overlapping sheets with thread along lines of stitches, comprising means for transporting a series of layers in a predetermined direction along a predetermined path; means for making pluralities of holes in successive layers of the series along the contemplated lines of stitches in a first portion of said path, said means for making holes comprising a plurality of tools, first drive means for moving said tools transversely of said path at first intervals and second drive means for moving said tools in said direction at second intervals each at least partially coinciding with one of said first intervals; and at least one sewing machine having means for introducing thread through the holes of successive layers in a second portion downstream of said first portion of said path.

13. The apparatus of claim 12, wherein said means for introducing thread includes means for forming a predetermined pattern of stitches and said means for making holes includes means for making a pattern of holes conforming to said pattern of stitches.

14. The apparatus of claim 12, wherein said means for making holes includes an array of tools arranged to simultaneously form a plurality of holes forming a pattern in a layer in the first portion of said path.

15. The apparatus of claim 14, wherein the number of tools in said array at most equals half the number of holes in each of said pluralities of holes.

16. The apparatus of claim 13, wherein said tools and said second drive means form part of said transporting means.

17. The apparatus of claim 12, wherein said transporting means comprises means for conveying layers in said direction in a third portion between said first and second portions of said path.

18. The apparatus of claim 17, wherein said conveying means includes at least one tool having means for entering the holes of layers arriving from the first portion of said path.

19. The apparatus of claim 17, wherein said conveying means comprises first and second tools having means for entering the holes of layers arriving from the first portion of said path and means for alternatingly engaging said first and second tools with a layer in the third portion of said path.

20. The apparatus of claim 12, further comprising means for trimming thread which is introduced into the holes of layers in said second portion of said path.

21. The apparatus of claim 20 for sewing together layers of overlapping sheets with thread which extends beyond opposite sides of layers downstream of said second portion of said path, said trimming means comprising means for trimming thread at both sides of successive layers downstream of said at least one sewing machine.

* * * * *